US011031725B2

(12) United States Patent
Tsai et al.

(10) Patent No.: US 11,031,725 B2
(45) Date of Patent: Jun. 8, 2021

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Dong-Fang Zeng, New Taipei (TW); Shien-Lung Huang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 16/750,496

(22) Filed: Jan. 23, 2020

(65) Prior Publication Data

US 2020/0235517 A1 Jul. 23, 2020

(30) Foreign Application Priority Data

Jan. 23, 2019 (CN) ..... 201910061468.4

(51) Int. Cl.
*H01R 13/52* (2006.01)
*H01R 24/62* (2011.01)
*H01R 13/502* (2006.01)

(52) U.S. Cl.
CPC ..... *H01R 13/52* (2013.01); *H01R 13/502* (2013.01); *H01R 24/62* (2013.01); *H01R 2201/06* (2013.01)

(58) Field of Classification Search
CPC .. H01R 13/424; H01R 13/426; H01R 13/502; H01R 13/6581; H01R 13/6585; H01R 13/6594; H01R 24/60
See application file for complete search history.

(56) References Cited

U.S. PATENT DOCUMENTS

| | | | | |
|---|---|---|---|---|
| 9,653,851 | B1 * | 5/2017 | Yuan | H01R 24/60 |
| 9,917,405 | B2 * | 3/2018 | Ju | H01R 13/6583 |
| 10,367,307 | B2 * | 7/2019 | Zhou | H01R 13/64 |
| 10,468,831 | B2 * | 11/2019 | Zhao | H01R 13/502 |
| 10,490,940 | B2 * | 11/2019 | Ju | H01R 13/6582 |
| 10,804,640 | B2 * | 10/2020 | Zhao | H01R 13/504 |
| 2015/0162684 | A1 * | 6/2015 | Amini | H01R 24/60 439/660 |
| 2017/0271823 | A1 * | 9/2017 | Zhao | H01R 13/50 |
| 2018/0358756 | A1 * | 12/2018 | Zhao | H01R 24/60 |
| 2019/0103697 | A1 * | 4/2019 | Amini | H01R 43/24 |
| 2019/0363495 | A1 * | 11/2019 | Ju | H01R 13/6585 |

* cited by examiner

*Primary Examiner* — Oscar C Jimenez
(74) *Attorney, Agent, or Firm* — Muncy, Geissler, Olds & Lowe, P.C.

(57) ABSTRACT

An electrical receptacle connector includes an insulated housing, receptacle terminals, and a metallic shell. The insulated housing includes a base portion and a tongue portion outwardly extending from the base portion. A coverage region adjacent to the base portion is held on a surface of the tongue portion. The receptacle terminals are held in the base portion and disposed at the surface of the tongue portion. The receptacle terminals include a body portion and a contact portion, the body portion is held in the base portion and the tongue portion, and the contact portion is outwardly extending from one end of the body portion. Each of the receptacle terminals includes an avoidance portion between the contact portion and the body portion. The avoidance portion of each of the receptacle terminals is covered by the coverage region of the tongue portion.

18 Claims, 14 Drawing Sheets

ELECTRICAL RECEPTACLE CONNECTOR

CROSS-REFERENCE TO RELATED APPLICATION

This non-provisional application claims priority under 35 U.S.C. § 119(a) to Patent Application No. 201910061468.4 filed in China, P.R.C. on Jan. 23, 2019, the entire contents of which are hereby incorporated by reference.

FIELD OF THE INVENTION

The instant disclosure relates to an electrical connector, and more particular to an electrical receptacle connector.

BACKGROUND

The transmission interface specifications of the electrical connector are quite diverse, such as HDMI or Universal Serial Bus (USB). The existing USB interconnects have the attributes of plug-and-play and ease of use by end users. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a USB type-C electrical connector known to the inventor(s) are totally different from those of a USB electrical connector known to the inventor(s). A USB type-C electrical plug connector known to the inventor(s) includes a plastic core, upper and lower plug terminals held on the plastic core, an outer iron shell circularly enclosing the plastic core, and conductive sheets held on the plastic core. After the type-c electrical receptacle connector is inserted into and detached from a mating type-c electrical plug connector for a period of time, the debris is easily piled up in the type-c electrical receptacle connector due to the friction between the receptacle terminals and the plug terminals. When the debris is accumulated to a certain extent, the debris may further occupy the space between the adjacent receptacle terminals, resulting in the indirect contact of the adjacent receptacle terminals to cause poor voltage-withstand performance or even cause the short circuit condition.

SUMMARY OF THE INVENTION

In view of this, an embodiment of the instant disclosure provides an electrical receptacle connector. The electrical receptacle connector comprises an insulated housing, a plurality of receptacle terminals, and a metallic shell. The insulated housing comprises a base portion and a tongue portion. The tongue portion is outwardly extending from one end of the base portion. A coverage region adjacent to the base portion is held on a surface of the tongue portion. The receptacle terminals are held in the base portion and disposed at an upper surface of the tongue portion or a lower surface of the tongue portion. The receptacle terminals comprise a body portion and a contact portion, the body portion is held in the base portion and the tongue portion, and the contact portion is outwardly extending from one end of the body portion and disposed at the upper surface of the tongue portion or the lower surface of the tongue portion. Each of the receptacle terminals comprises an avoidance portion between the contact portion and the body portion.

The avoidance portion of each of the receptacle terminals is covered by the coverage region of the tongue portion. The metallic shell comprises a receptacle cavity. The insulated housing is held in the receptacle cavity.

In one or some embodiments, when a plurality of plug terminals of an electrical plug connector is in contact with the receptacle terminals of the electrical receptacle connector respectively, the debris is generated on the coverage region of the surface of the tongue portion on the avoidance portions.

In one or some embodiments, the electrical plug connector is inserted into and positioned in the electrical receptacle connector, a plurality of contact ends of the plug terminals is adjacent to the coverage region.

In one or some embodiments, a thickness of the avoidance portion of each of the receptacle terminals is less than a thickness of the contact portion of each of the receptacle terminals.

In one or some embodiments, an end of the avoidance portion of each of the receptacle terminals is in the base portion.

In one or some embodiments, a thickness of the base portion is greater than a thickness of the tongue portion.

In one or some embodiments, the coverage region covers from an end portion of the contact portion to an end portion of the base portion.

In one or some embodiments, a covering range of the coverage region is from one of two sides of the tongue portion to the other side of the tongue portion.

In one or some embodiments, the surface of the tongue portion at the coverage region and a surface of each of the contact portions are substantially aligned in a same horizontal plane.

In one or some embodiments, the insulated housing further comprises two metal sheets arranged at two sides of the tongue portion. Each of the metal sheets comprises a hook structure protruding from a side of the tongue portion and a through hole adjacent to the hook structure.

In one or some embodiments, the electrical receptacle connector further comprises a fixation block. Each of the receptacle terminals is at a position on the fixation block and combined with the insulated housing.

In one or some embodiments, a plurality of blocks is outwardly protruding from the fixation block and held with two sides of each of the receptacle terminals. The blocks are received in the through holes, respectively.

In one or some embodiments, each of the through holes has an expanded portion extending to the corresponding hook structure.

In one or some embodiments, an extension portion and a soldering leg are outwardly extending from two sides of each of the metal sheets. A plurality of blocks is are outwardly protruding from the fixation block and are held with two sides of each of the extension portions.

In one or some embodiments, the insulated housing further comprises a metal sheet arranged at two sides of the tongue portion. The metal sheet comprises a plurality of hook structures protruding from a side of the tongue portion and a plurality of through holes respectively adjacent to the hook structures.

In one or some embodiments, the electrical receptacle connector further comprises a fixation block. Each of the receptacle terminals is at a position on the fixation block and combined with the insulated housing.

In one or some embodiments, a plurality of blocks are outwardly protruding from the fixation block and held with two sides of each of the receptacle terminals. The blocks are received in the through holes, respectively.

In one or some embodiments, each of the through holes has an expanded portion extending to the corresponding hook structure.

In one or some embodiments, a plurality of extension portions and a plurality of soldering legs are outwardly extending from two sides of the metal sheet, a plurality of blocks is outwardly protruding from the fixation block and is held with two sides of each of the extension portions.

An embodiment of the instant disclosure provides the coverage region. When the plug terminals of the electrical plug connector are respectively in contact with the receptacle terminals of the electrical receptacle connector, the debris is produced on the coverage region which is on the avoidance portions of the surfaces of the tongue portion. After the receptacle terminals and the plug terminals are mated with and detached from each other for a period of time, terminals can be prevented from suffering poor voltage-withstand performance or the short circuit condition due to the stacking of the debris. Furthermore, the area of the tongue portion made of plastic covering the receptacle terminals becomes larger (as the coverage area of the coverage region is added), so as to avoid the contact portions of the receptacle terminals of the electrical receptacle connector from warping and protruding on the surfaces of the tongue portion due to processing and high temperature baking procedures.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
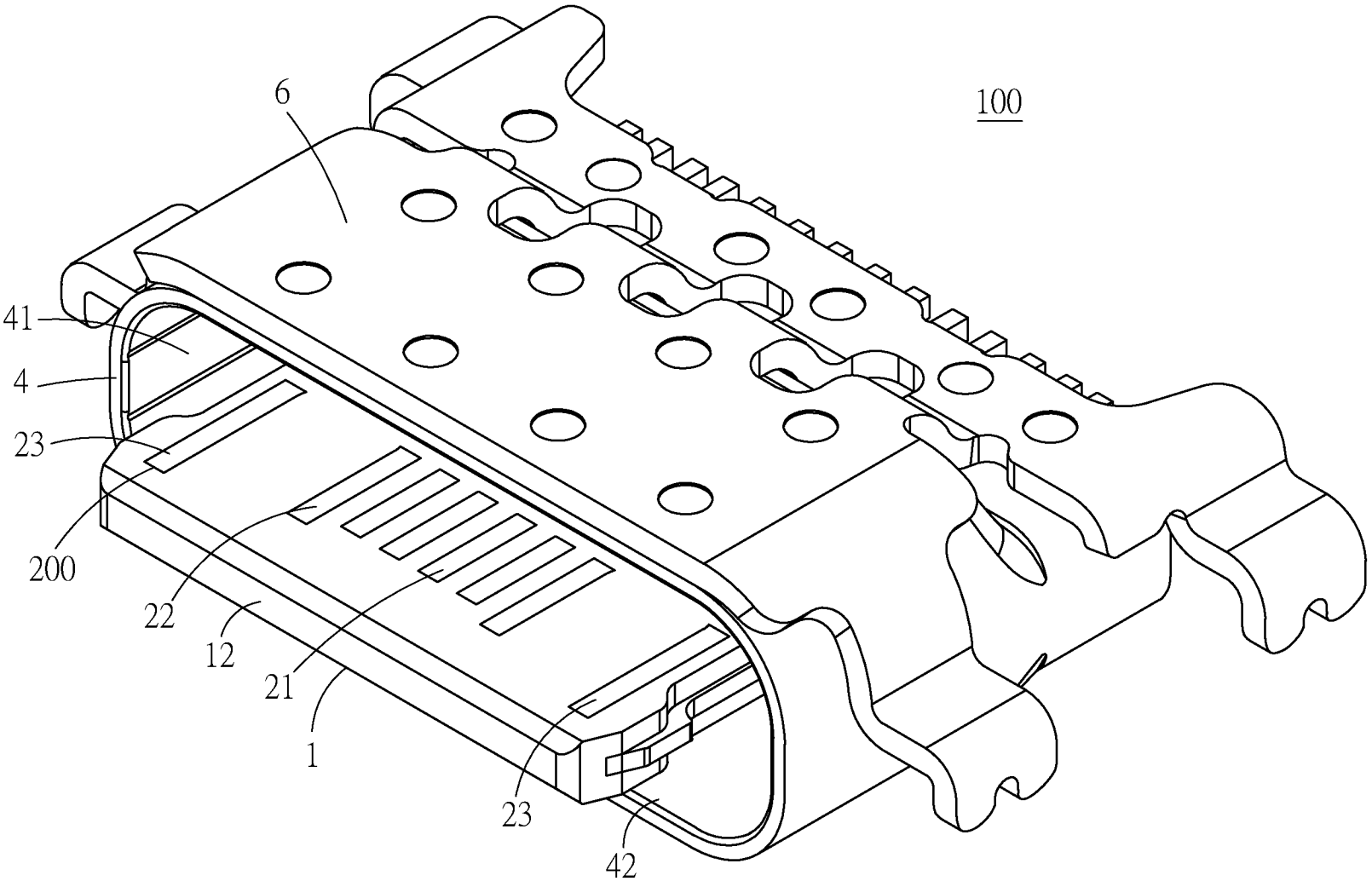
FIG. 1 illustrates a perspective view of an electrical receptacle connector according to an exemplary embodiment of the instant disclosure.
Figure 2:
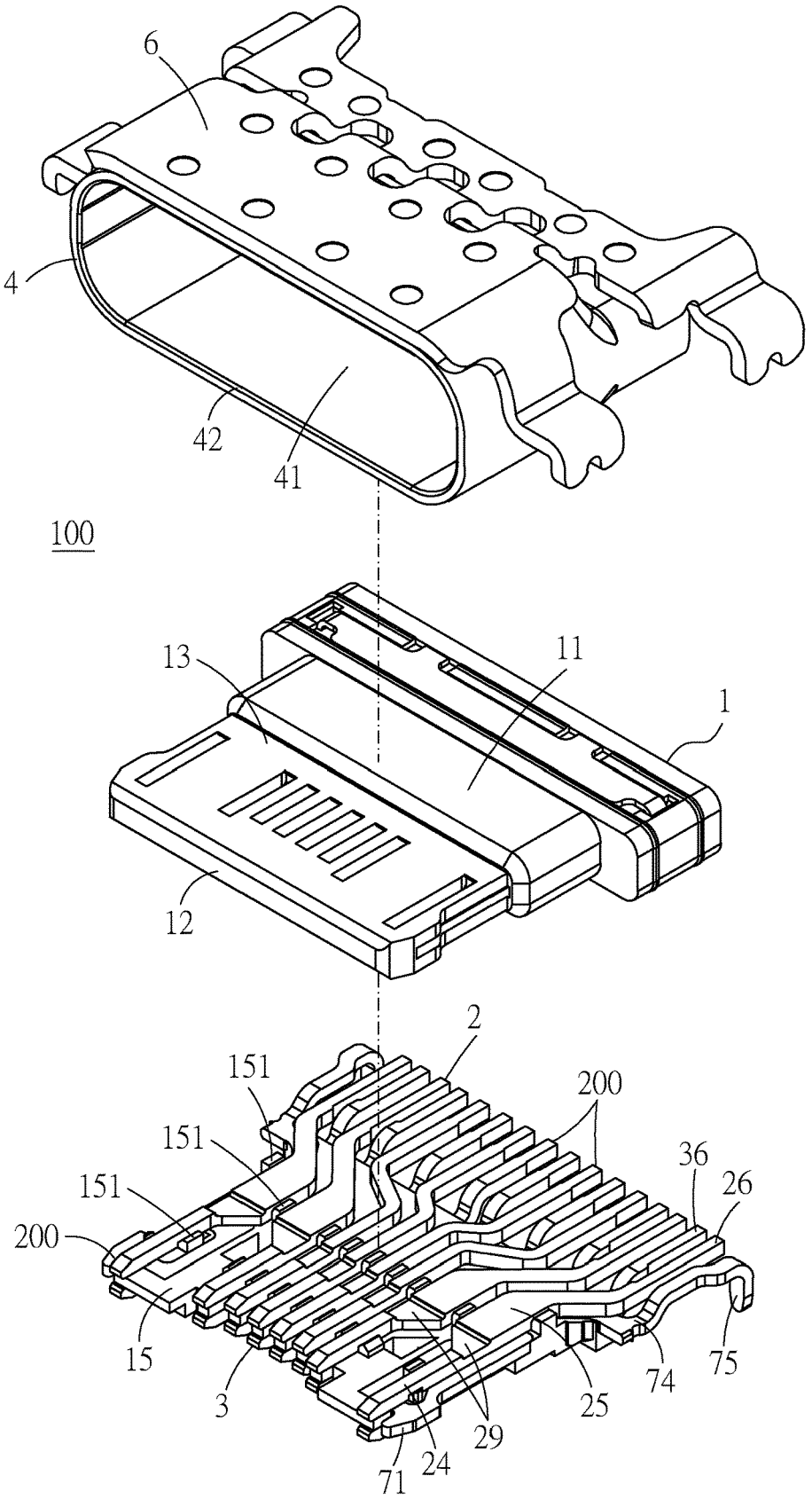
FIG. 2 illustrates an exploded view (1) of the electrical receptacle connector of the exemplary embodiment.
Figure 3:
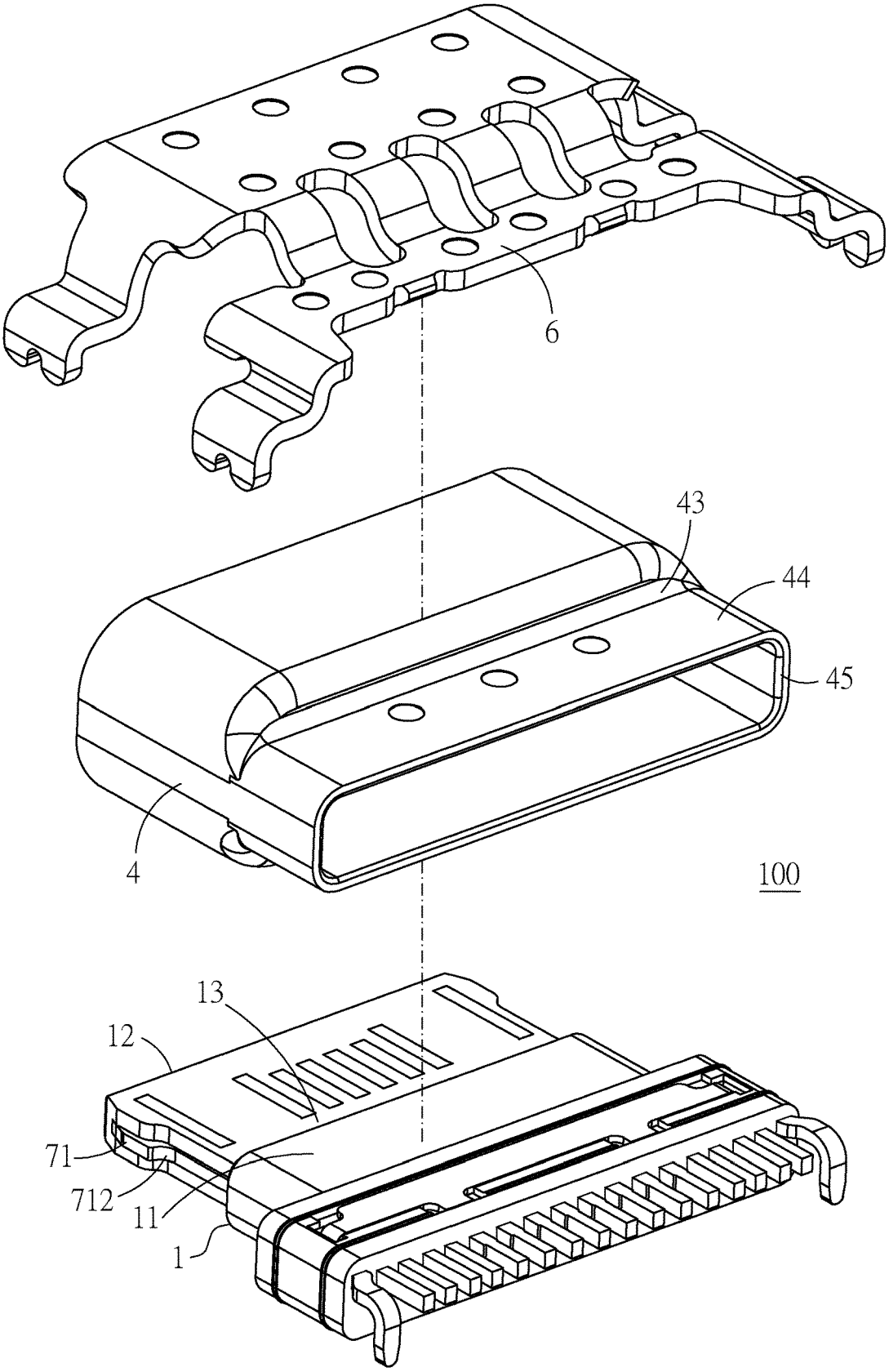
FIG. 3 illustrates an exploded view (2) of the electrical receptacle connector of the exemplary embodiment.
Figure 4:
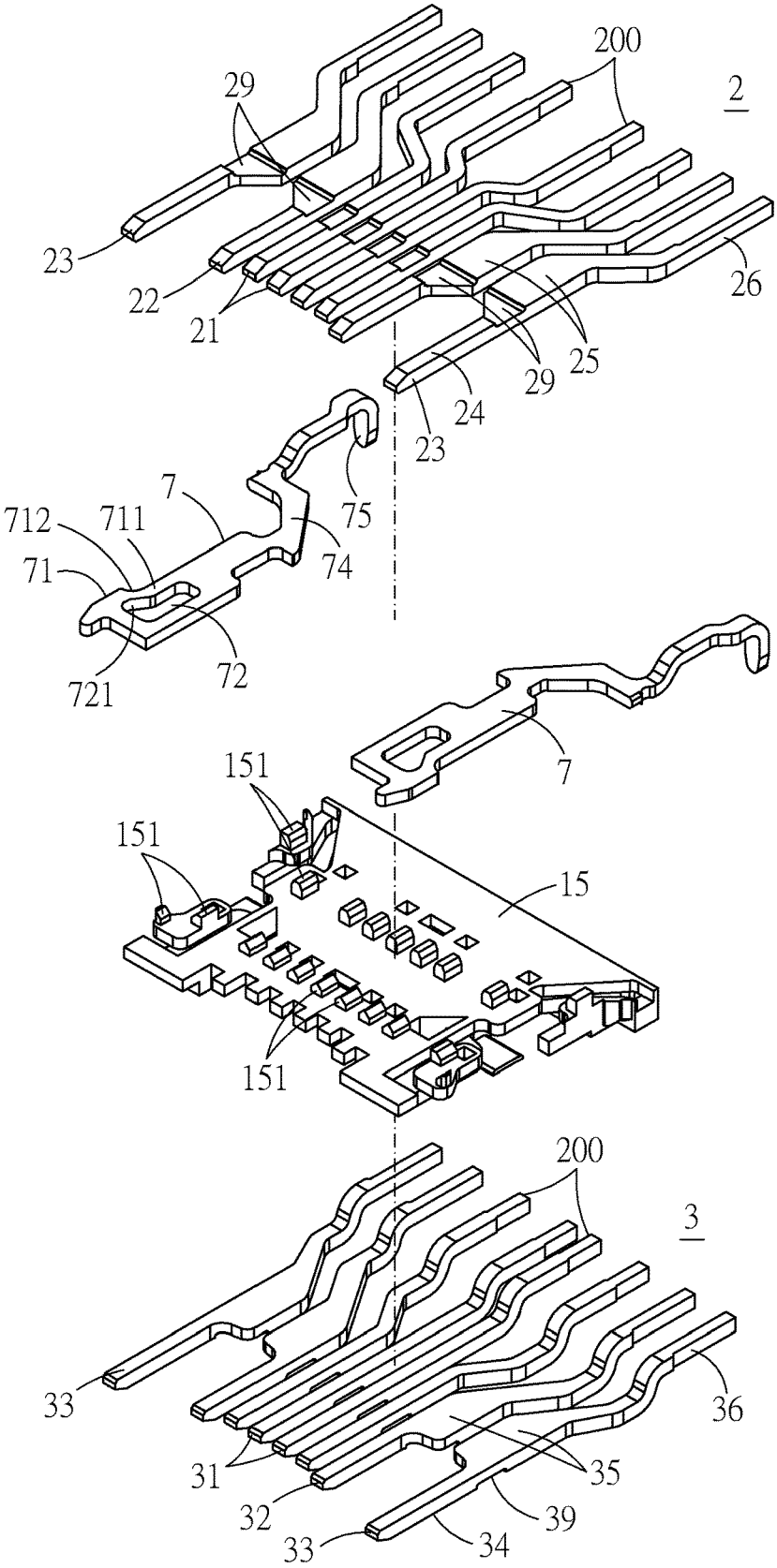
FIG. 4 illustrates an exploded view of a plurality of receptacle terminals of the electrical receptacle connector of the exemplary embodiment.
Figure 5:
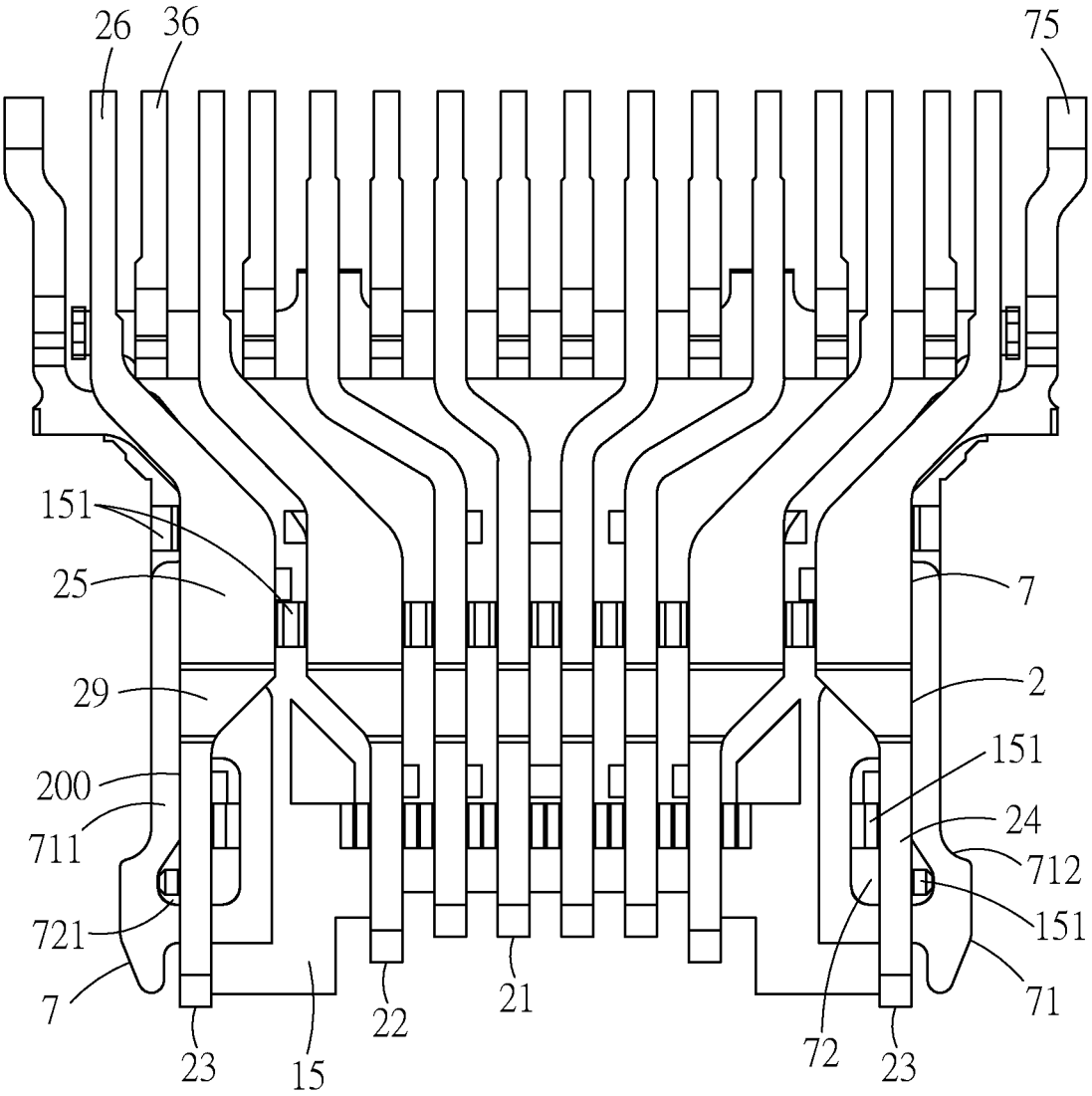
FIG. 5 illustrates a top view of the receptacle terminals of the electrical receptacle connector of the exemplary embodiment.
Figure 6:
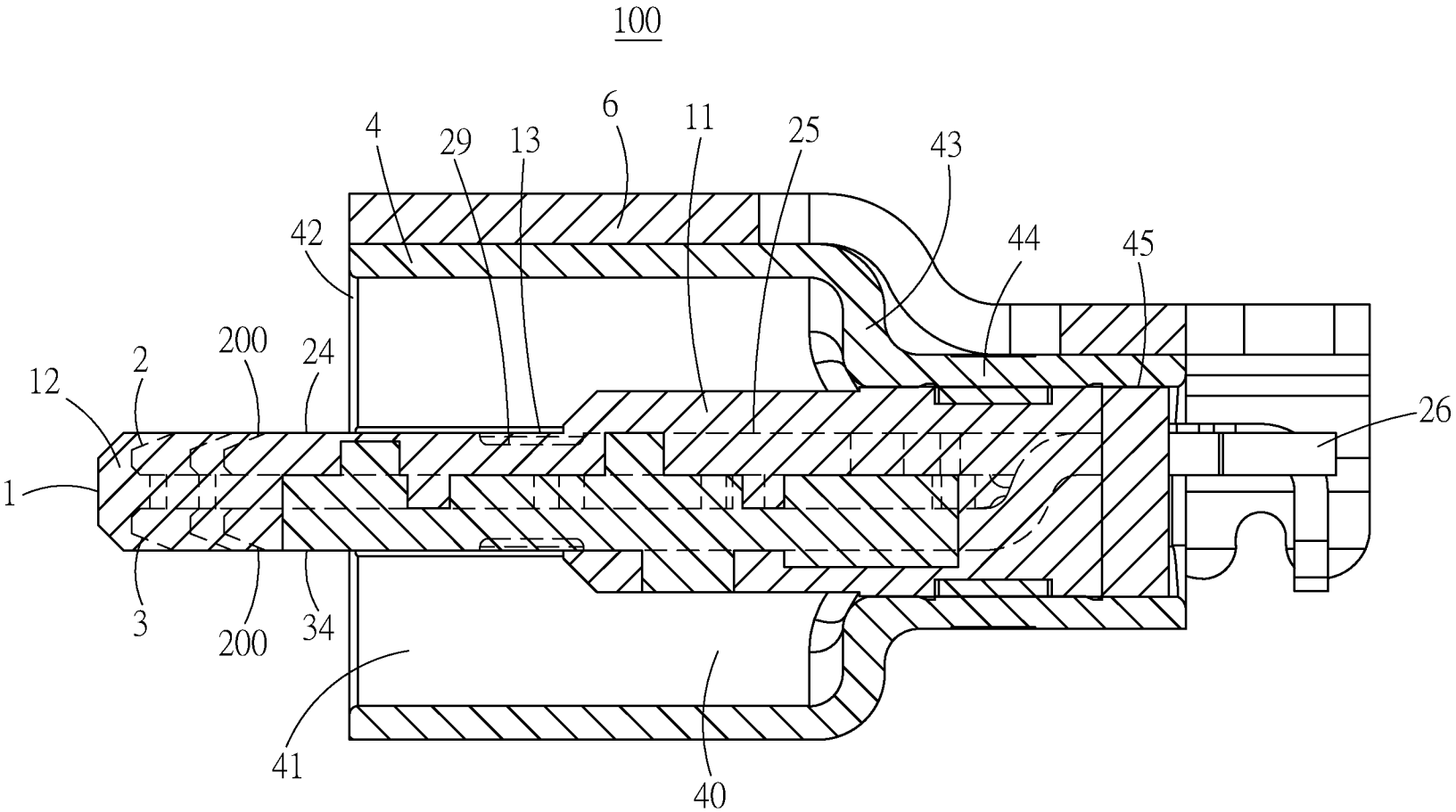
FIG. 6 illustrates a lateral cross-sectional view of the electrical receptacle connector of the exemplary embodiment.
Figure 7:
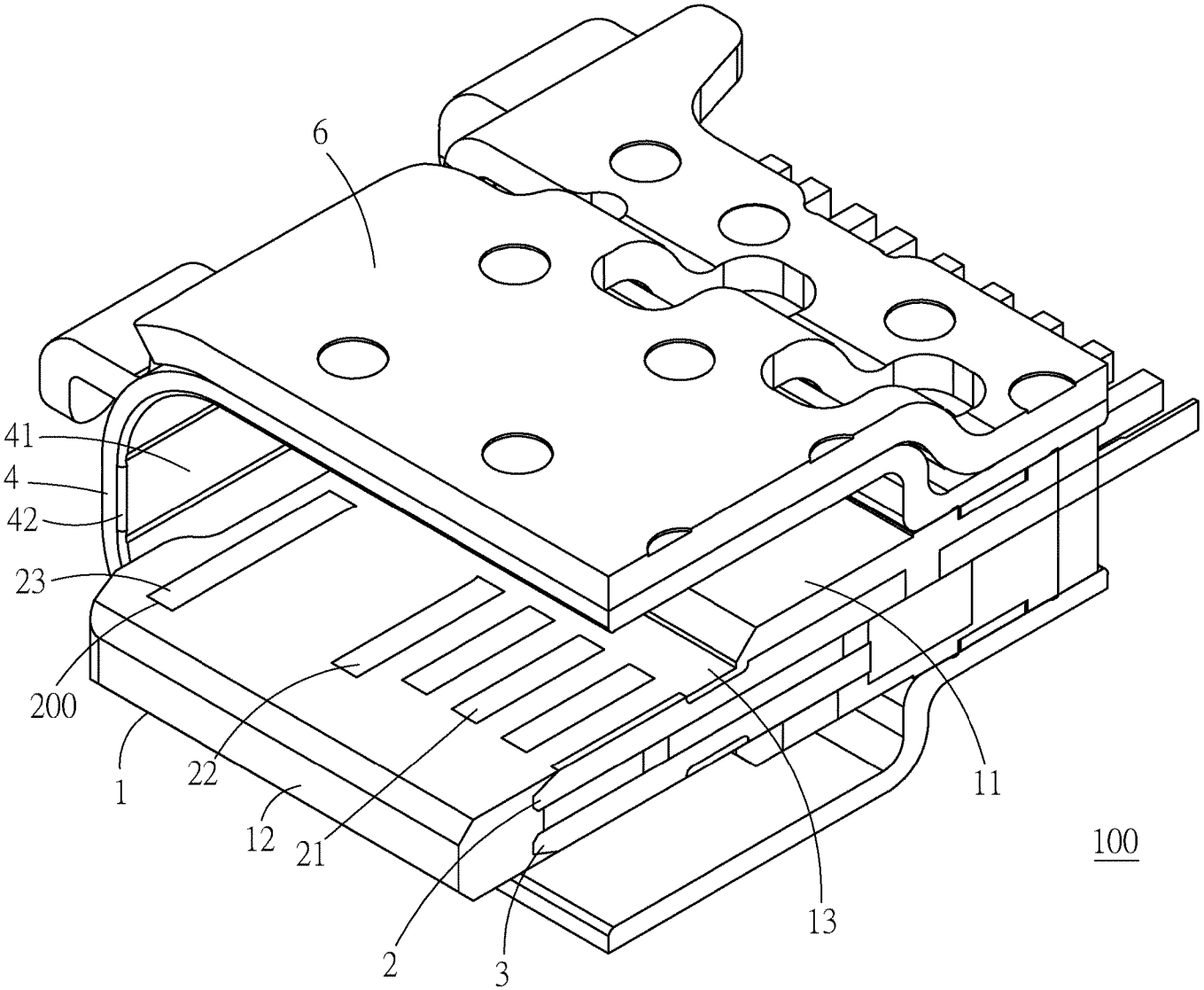
FIG. 7 illustrates a perspective cross-sectional view of the electrical receptacle connector of the exemplary embodiment.

Please refer to FIGS. 1 to 7, illustrating an electrical receptacle connector 100 according to an exemplary embodiment of the instant disclosure. FIG. 1 illustrates a front perspective view thereof, FIG. 2 illustrates a front exploded view (1) thereof, FIG. 3 illustrates a back exploded view (2) thereof, FIG. 4 illustrates an exploded view of a plurality of receptacle terminals 200 thereof, FIG. 5 illustrates a top view of the receptacle terminals 200 thereof, FIG. 6 illustrates a lateral cross-sectional view thereof, and FIG. 7 illustrates a perspective cross-sectional view thereof.

In this embodiment, the electrical receptacle connector 100 provides a USB Type-C connector interface, but embodiments are not limited thereto. In some embodiments, the electrical receptacle connector 100 may provide an HDMI connector interface. In this embodiment, the electrical receptacle connector 100 is a USB Type-C receptacle connector. The electrical receptacle connector 100 comprises an insulated housing 1, a plurality of receptacle terminals 200, and a metallic shell 4.

In this embodiment, the insulated housing 1 is an elongated plate, and may be formed by multiple pieces or a single piece of plastic base. In this embodiment, the insulated housing 1 is a single piece. The insulated housing 1 comprises a base portion 11 and a tongue portion 12. In this embodiment, the base portion 11 and the tongue portion 12 are formed by injection-molding process. The tongue portion 12 is outwardly extending from one side of the base portion 11.

In this embodiment, the receptacle terminals 200 are held in the base portion 11, and the receptacle terminals 200 are disposed at an upper surface of the tongue portion 12 and/or a lower surface of the tongue portion 12.

In this embodiment, the metallic shell 4 is a hollow shell. The metallic shell 4 comprises a receptacle cavity 41. The metallic shell 4 covers the insulated housing 1, that is, the insulated housing 1 is received in the receptacle cavity 41. The metallic shell 4 has a first end and a second end opposite to the first end. An insertion opening 42 is on the first end of the metallic shell 4, and the insertion opening 42 is located at the outer peripheral region of the tongue portion 12. A stopping portion 43 is bending down from an upper plate of the metallic shell 4 toward the surface of the base portion 10. The stopping portion 43 is extending to the surface of the base portion 11.

Figure 9:
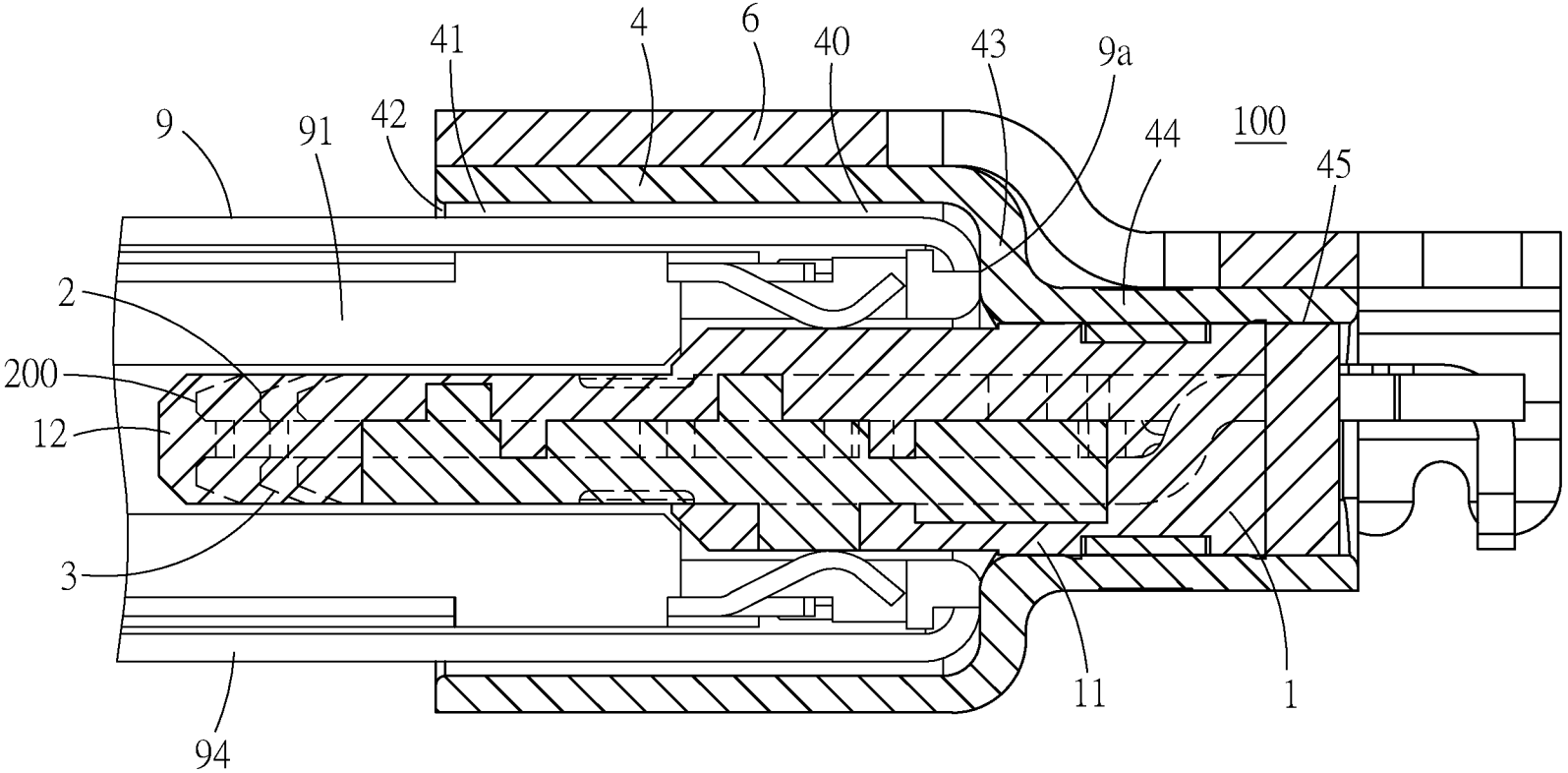
FIG. 9 illustrates a lateral view showing that an electrical plug connector is mating with the electrical receptacle connector of the exemplary embodiment.

In this embodiment, the stopping portion 43 is vertically extending to the surface of the base portion 11. The insertion space 40 is formed between the surface of the base portion 11 and the inner surface of the metallic shell 4. An electrical plug connector 9 is inserted to the insertion space 40 through the insertion opening 42 (as shown in FIG. 9). In an electrical receptacle connector known to the inventor(s), the insertion space is not formed between the surface of the base portion and the inner surface of the metallic shell, and the electrical plug connector known to the inventor(s) can be just inserted to the base portion, stopped by the base portion, and failed to be inserted into the insertion space.

Please refer to FIGS. 2, 7, and 9. FIG. 9 illustrates a lateral view showing that the electrical plug connector 9 is mating with the electrical receptacle connector 100. In this embodiment, when the electrical plug connector 9 is inserted into the receptacle cavity 41, the end portion 9*a* of the electrical plug connector 9 is in contact with the stopping portion 43. The metallic shell 4 (made of iron material) is in contact with the electrical plug connector 9. When the electrical plug connector 9 is completely inserted into the receptacle cavity 41, the insertion force can be dispersed over the metallic shell 4 to avoid the insulated housing 1 from being impacted by the electrical plug connector 9, thereby ensuring the receptacle terminals 200 held in the insulated housing 1 from being squeezed or deformed. Hence, the problem of the receptacle terminals held in the insulated housing are squeezed or deformed in the case that the insulated housing (made of plastic material) is used as the stop of the electrical plug connector known to the inventor(s) when the insulated housing is impacted, can be solved.

In other words, the stopping portion 43 (or the stopping surface) of the electrical receptacle connector 100 in this embodiment is replaced, from the insulated housing 1 (made of plastic material) known to the inventor(s) by the metallic shell 4 (made of iron material) according to one or some embodiments of the instant disclosure. In this embodiment, the electrical plug connector 9 comprises an insulating body 91 and a shell 94 covering the insulating body 91. The end portion 9*a* of the insulating body 9 and the end portion 9*a* of the shell 94 are adapted to be in contact with the stopping portion 43.

In this embodiment, the second end of the metallic shell 4 comprises an extension portion 44 extending outwardly from an end of the stopping portion 43. The extension portion 44 is abutted against the surface of the base portion 11. The stopping portion 43 and the extension portion 44 are substantially vertical to each other. Furthermore, the extension portion 44 on the second end of the metallic shell 4 is a shrunken frame structure 45. An inner diameter of the shrunken frame structure 45 is less than an inner diameter of the insertion opening 42, thereby configuring the metallic shell 4 with two end openings in different sizes.

Figure 8:
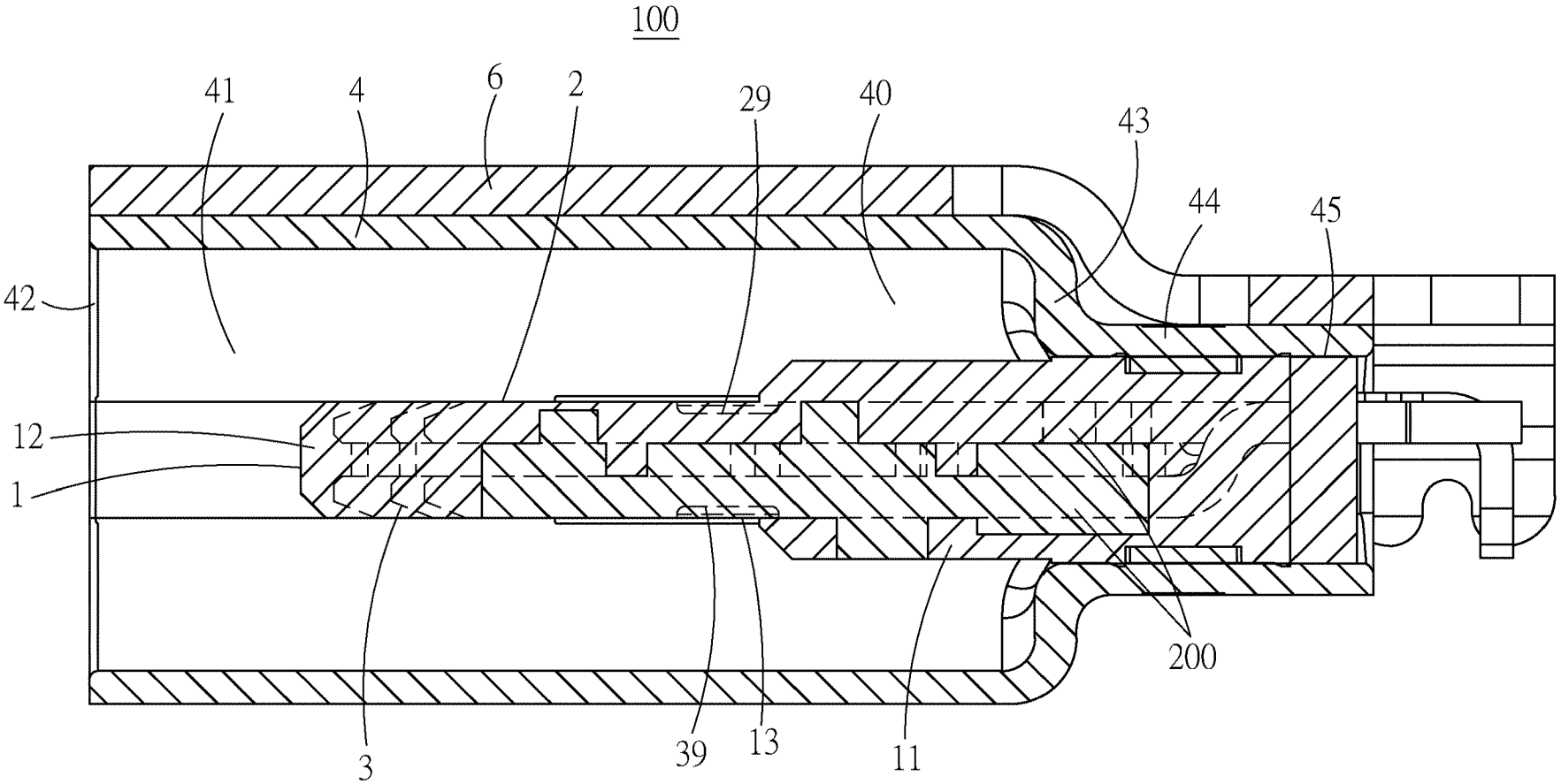
FIG. 8 illustrates a lateral cross-sectional view of another embodiment of the metallic shell of the electrical receptacle connector of the exemplary embodiment.

Please refer to FIGS. 1 and 8. FIG. 8 illustrates a lateral cross-sectional view of another embodiment of the metallic shell 4. In this embodiment, the tongue portion 12 is exposed out of the insertion opening 42, but embodiments are not limited thereto. In some embodiments, the tongue portion 12 may be in the receptacle cavity 41. In other words, the length of the metallic shell 4 may be shortened to expose the tongue portion 12, or the length of the metallic shell 4 may be extended, so that the tongue portion 12 can be received in the receptacle cavity 41. Because the metallic shell 4 may be changed in different lengths, the electrical plug connector 9 can be applied to different specifications (one specification of an electrical plug connector is shown in FIG. 9); alternatively, according to electronic products with different assembling requirements, the metallic shell 4 with different lengths can be utilized.

In this embodiment, the electrical receptacle connector 100 further comprises a cover 6 covering the metallic shell 4. In this embodiment, the cover 6 and the metallic shell 4 are separated elements, but embodiments are not limited thereto. In some embodiments, the cover 6 and the metallic shell 4 are a one-piece member.

In this embodiment, the receptacle terminals 200 comprises a plurality of first terminals 2. The first terminals 2 are held in the base portion 11 and the tongue portion 12. In this embodiment, the first terminals 2 comprises a plurality of first signal terminals 21, at least one first power terminal 22, and at least one first ground terminal 23. The first terminals 2 are held in the base portion 11, and disposed at an upper surface of the tongue portion 12.

In this embodiment, from a front view of the first terminals 2, the first terminals 2 comprise, from left to right, a first ground terminal 23 (Gnd), a first power terminal 22 (Power/VBUS), a pair of first signal terminals 21 (D+−, differential signal terminals), a reserved terminal (RFU), and another first ground terminal 23 (Gnd), but embodiments are not limited thereto.

In one embodiment, from a front view of the first terminals 2, the first terminals 2 comprise, from left to right, a first ground terminal 23 (Gnd), a first pair first signal terminals 21 (TX1+−, differential signal terminals), a second pair first signal terminals 21 (D+−, differential signal terminals), a third pair first signal terminals 21 (RX2+−, differential signal terminals), and a first power terminal 22 (Power/VBUS), a reserved terminal (RFU), and another first ground terminal 23 (Gnd) between three pairs of first signal terminals 21. The provided specification is for USB 3.0 signal transmission.

Each of the first terminals 2 comprises a first contact portion 24, a first body portion 25, and a first tail portion 26. The first body portions 25 are held in the base portion 11 and the tongue portion 12. The first contact portions 24 are extending forward from the first body portions 25 and disposed at the upper surface of the tongue portion 12. The first tail portions 26 are extending backward from the first body portions 25 and protruding out of the base portion 11. The first signal terminals 21 are disposed at the upper surface of the tongue portion 12 for transmitting first signals (i.e., USB 2.0 signals). The first tail portions 26 are protruding out of the back of the base portion 11, and may be bent horizontally to form flat legs, named legs manufactured by SMT (surface mounted technology). Alternatively, the first tail portions 26 may be extending downwardly to form vertical legs, named legs manufactured by through-hole technology.

In this embodiment, the receptacle terminals 200 comprises a plurality of second terminals 3. The second terminals 3 are held in the base portion 11 and the tongue portion 12. In this embodiment, the second terminals 3 comprises a plurality of second signal terminals 31, at least one second power terminal 32, and at least one second ground terminal 33. The second terminals 3 are held in the base portion 11, and disposed at a lower surface of the tongue portion 12.

In this embodiment, from a front view of the second terminals 3, the second terminals 3 comprise, from right to left, a second ground terminal 33 (Gnd), a second power terminal 32 (Power/VBUS), a pair of second signal terminals 31 (D+−, differential signal terminals), a reserved terminal (RFU), and another second ground terminal 33 (Gnd), but embodiments are not limited thereto.

In one embodiment, from a front view of the second terminals 3, the second terminals 3 comprise, from right to left, a second ground terminal 33 (Gnd), a second pair second signal terminals 31 (TX2+–, differential signal terminals), a second pair second signal terminals 31 (D+–, differential signal terminals), a third pair second signal terminals 31 (RX1+–, differential signal terminals), and a second power terminal 32 (Power/VBUS), a reserved terminal (RFU), and another second ground terminal 33 (Gnd) between three pairs of second signal terminals 31. The provided specification for USB 3.0 signal transmission.

Each of the second terminals 3 comprises a second contact portion 34, a second body portion 35, and a second tail portion 36. The second body portions 35 are held in the base portion 11 and the tongue portion 12. The second contact portions 34 are extending forward from the second body portions 35 and disposed at the lower surface of the tongue portion. The second tail portions 36 are extending backward from the second body portions 35 and protruding out of the base portion 11. The second signal terminals 31 are disposed at the lower surface of the tongue portion for transmitting second signals (i.e., USB 2.0 signals). The second tail portions 36 are protruding out of the back of the base portion 11, and may be bent horizontally to form flat legs, named legs manufactured by SMT (surface mounted technology). Alternatively, the second tail portions 36 may be extending downwardly to form vertical legs, named legs manufactured by through-hole technology.

In this embodiment, the first terminals 2 and the second terminals 3 are respectively held on the upper surface of the tongue portion 12 and the lower surface of the tongue portion 12. Moreover, pin-assignments of the first terminals 2 and the second terminals 3 are point-symmetrical with a central point of the receptacle cavity 41 as the symmetrical center. In other words, pin-assignments of the first terminals 2 and the second terminals 3 have 180-degree symmetrical design with respect to the central point of the receptacle cavity 41 as the symmetrical center. Here, point-symmetry means that after the first terminals 2 (or the second terminals 3), are rotated by 180 degrees with the symmetrical center as the rotating center, the first terminals 2 and the second terminals 3 are overlapped. That is, the rotated first terminals 2 are arranged at the position of the original second terminals 3, and the rotated second terminals 3 are arranged at the position of the original first terminals 2.

In other words, the first terminals 2 and the second terminals 3 are upside-down, and pin-assignments of the first contact portions 24 is left-right reversal with respect to that of the second contact portions 34. Therefore, the electrical plug connector 9 may be inserted into the electrical receptacle connector 100 with a first orientation for transmitting first signals. Conversely, the electrical plug connector 9 may also be inserted into the electrical receptacle connector 100 with a second orientation for transmitting second signals. Furthermore, the specification for transmitting the first signals is conformed to the specification for transmitting the second signals. Note that, the inserting orientation of the electrical plug connector 9 is not limited by the electrical receptacle connector 100.

In this embodiment, from a front view of the first terminals 2 and the second terminals 3, the positions of the first terminals 2 correspond to the positions of the second terminals 3.

Figure 10:
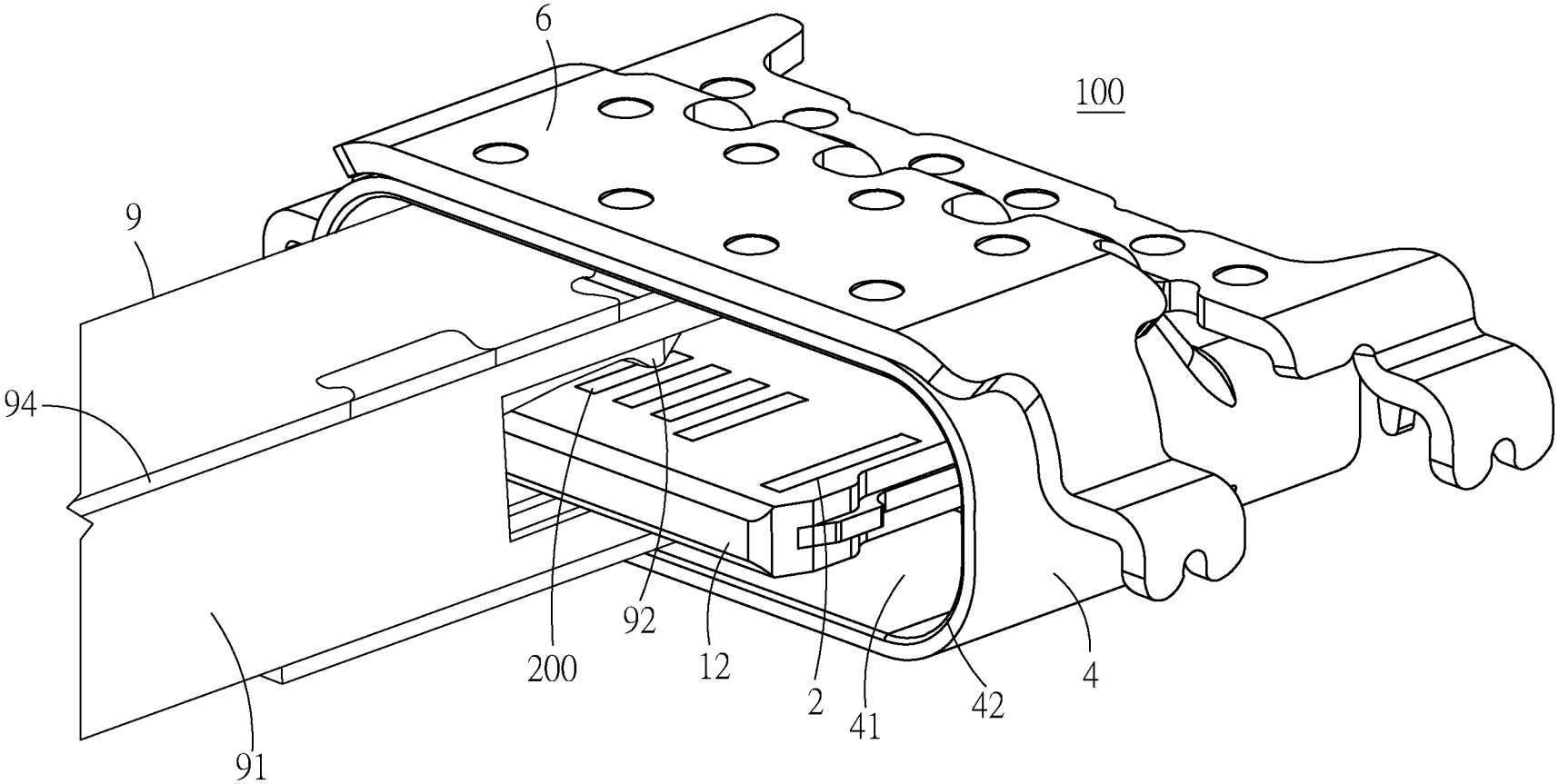
FIG. 10 illustrates a perspective view showing that the electrical plug connector is mating with the electrical receptacle connector of the exemplary embodiment.
Figure 11:
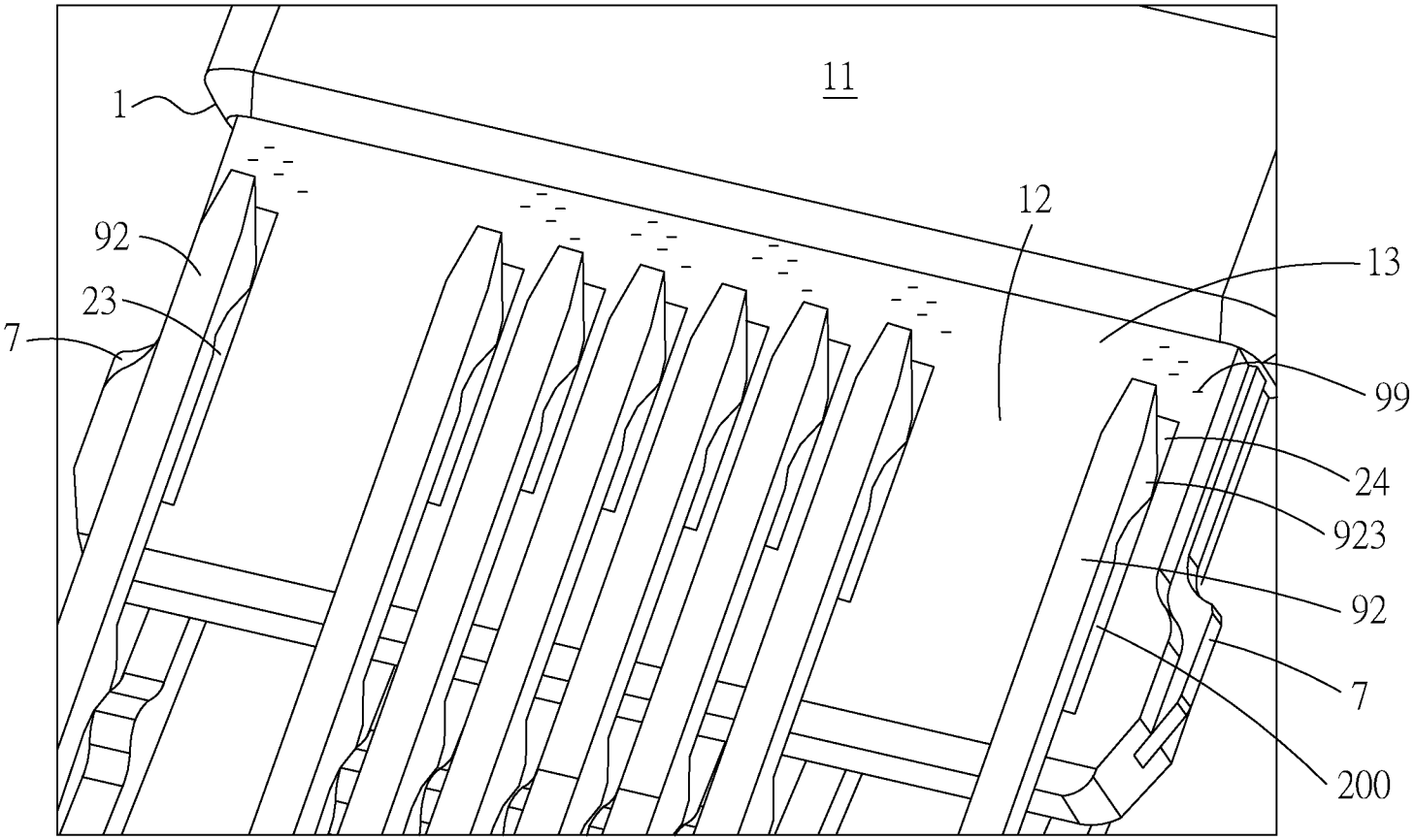
FIG. 11 illustrates a perspective view showing a plurality of contact portions of the receptacle terminals and a tongue portion, according to the electrical receptacle connector of the exemplary embodiment.
Figure 12:
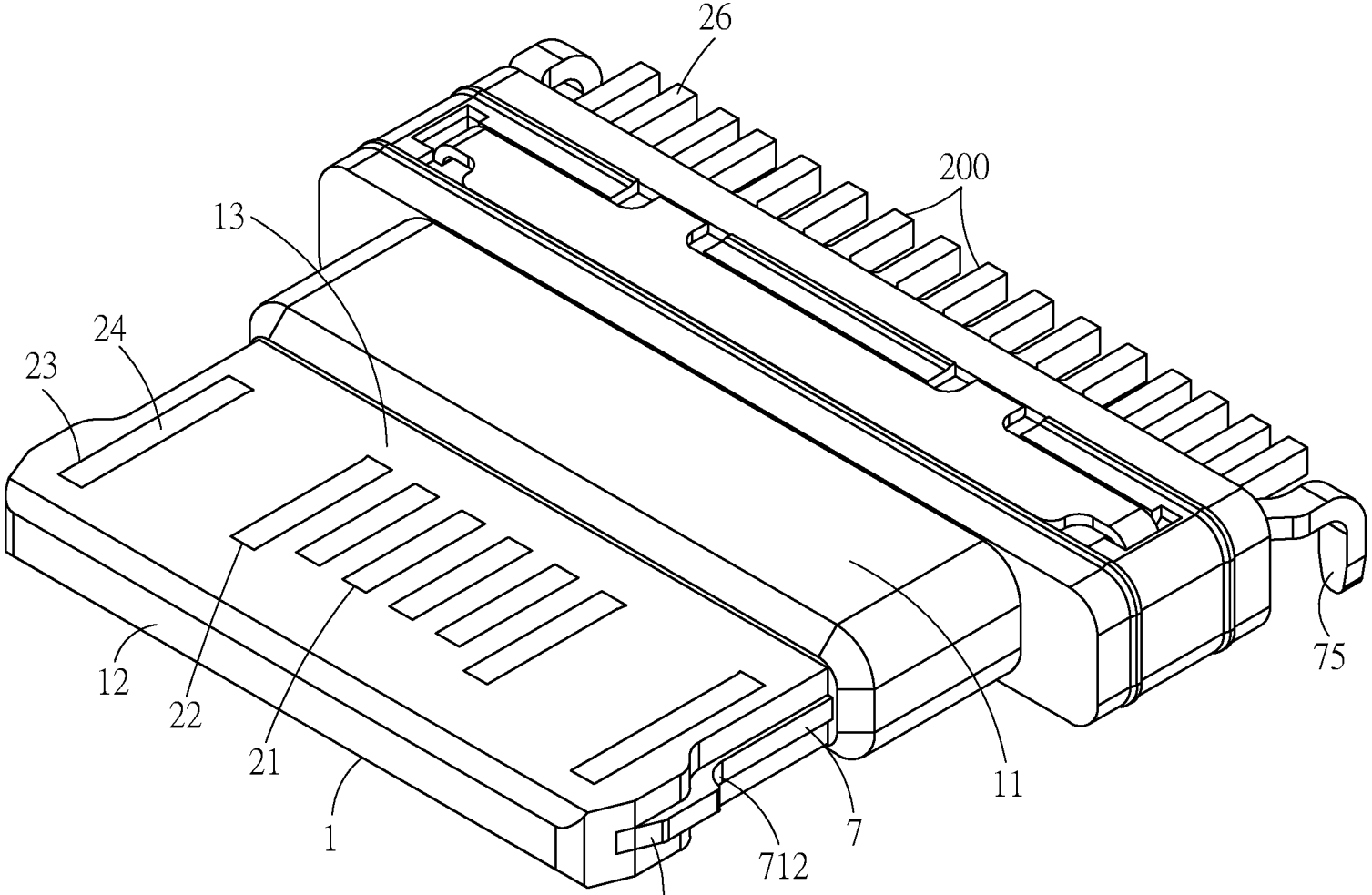
FIG. 12 illustrates a perspective view of an insulated housing of the electrical receptacle connector of the exemplary embodiment.

Please refer to FIGS. 2, 4, 6, 7, and 9 to 12. FIG. 10 illustrates a perspective view showing that the electrical plug connector 9 is mating with the electrical receptacle connector 100. In FIG. 10, the electrical plug connector 9 is cut off in half. FIG. 11 illustrates a perspective view showing that the tongue portion is mating with the plug terminals 92. FIG. 12 illustrates a perspective view of the insulated housing 1.

In this embodiment, the surface of the tongue portion 12 comprises an entire row coverage region (hereinafter, coverage region 13) adjacent to the base portion 11. The thickness of the base portion 11 is slightly greater than the thickness of the tongue portion 12. The coverage region 13 is on the tongue portion 12 adjacent to the base portion 10. In this embodiment, the coverage area of the coverage region 13 is extending from one of two sides of the tongue portion 12 to the other side of the tongue portion 12. That is, the coverage region 13 is fully configured on the inner surface of the tongue portion 12. The coverage region 13 is formed on the inner surface of the tongue portion 12 and devoid of the first contact portions 24 and the second contact portions 34 (the first contact portions 24 and the second contact portions 34 are the contact portions). The coverage region 13 is not the contact area of the plug terminals 92 the electrical plug connector 9. The surface of the tongue portion 12 at the coverage region 13 and the surface of the contact portions 24, 34 are substantially aligned in a same horizontal plane.

In this embodiment, the receptacle terminals 200 comprise the body portions (the first body portions 25 or the second body portions 35) held in the base portion 11 and the tongue portion 12, and the contact portions (the first contact portions 24 or the second contact portions 34) extending from one end of the body portions and held in the upper surface and the lower surface of the tongue portion 12. Each of the receptacle terminals 200 comprises the avoidance portions 29, 39 between the contact portions and the body portions (as shown in FIG. 4).

In this embodiment, the thickness of each of the avoidance portions 29, 39 of the receptacle terminals 200 is less than the thickness of each of the contact portions (the first contact portions 24 or the second contact portions 34) of the receptacle terminals 200. Furthermore, each of the avoidance portions 29, 39 is held between the tongue portion 12 and the base portion 11 (as shown in FIG. 8). The avoidance portions 29, 39 of each of the receptacle terminals 200 are covered with the coverage region 13 of the tongue portion 12. In this embodiment, the thickness of the base portion 11 is slightly greater than the thickness of the tongue portion 12. One end of each of the avoidance portions 29, 39 of each of the receptacle terminals 200 is in the base portion 11.

In this embodiment, the space provided by the avoidance portions 29 of the first ground terminals 23 and the first power terminals 22 is greater than the space provided by the avoidance portions 29 of the first signal terminals 21. That is, the width of the first ground terminals 23 and the first power terminals 22 becomes larger at the avoidance portions 29. The width of the first contact portions 24 of the first signal terminals 21 is the same as the width of avoidance portions 29. Furthermore, the design of each of the second terminals 3 is the same.

In this embodiment, when the plug terminals 92 of the electrical plug connector 9 are in contact with the receptacle terminals 200 of the electrical receptacle connector 100, debris 99 is produced on the avoidance portions 29, 39 of the upper and lower surfaces of the tongue portion 12 (in FIG. 11, only the upper surface of the tongue portion 12 is shown) due to friction of metals.

In particular, when the receptacle terminals 200 are frictionally in contact with the plug terminals 92, the debris 99 is easily piled up at the area between the tongue portion 12 and the base portion 11. Therefore, when the insulated housing 1 is formed by thinning the thickness of the avoidance portions 29, 39 of the receptacle terminals 200, the tongue portion 12 made of plastic is covered on each of the avoidance portions 29, 39. Accordingly, the debris 99 is on the coverage region 13.

Hence, with such arrangement, after the electrical receptacle terminals 200 and the electrical plug terminals 92 are mated with and detached from each other for a period of time, terminals with different properties (adjacent plug terminals 92, receptacle terminals 200, or plug terminals 92 and receptacle terminals 200) can be prevented from suffering poor voltage-withstand performance or being conducted with each other to cause the short circuit condition due to the stacking of the debris 99.

The area of the tongue portion 12 made of plastic covering the receptacle terminals 200 becomes larger (the coverage area of the coverage region 13 is added), so as to avoid the contact portions (the first contact portions 24 or the second contact portions 34) of the receptacle terminals 200 of the electrical receptacle connector 100 from warping and protruding on the surfaces of the tongue portion 12 due to processing and high temperature baking procedures.

In the connector known to the inventor(s), the contact portions of the receptacle terminals known to the inventor(s) are held in the area of the whole tongue portion (without having the coverage area of the coverage region). The plastic tongue portion is formed on the contact portions of the receptacle terminals. After the thermal expansion and cold shrinkage in the processing procedure, small terminal slots are formed between the plastic (tongue portion) and the metal (terminals). When conductive particles or water enter into the terminal slots, the adjacent receptacle terminals may suffer poor voltage-withstand performance or may be in contact with each other to cause the short circuit condition. In this embodiment, the coverage area of coverage region 13 is added to avoid that conductive particles or water enter into the terminal slots to cause poor voltage-withstand performance or to have the adjacent receptacle terminals 200 contacting with each other to cause the short circuit condition. Furthermore, during the process of injection molding, since the connector is devoid of terminal slot, the flow of the injected plastic material is not blocked. Hence, it is effectively to improve the phenomenon of insufficient molding during the molding process and to increase the strength of the product(s) having the electrical receptacle connector 100.

In this embodiment, the electrical receptacle connector 100 further comprises a fixation block 15 (as shown in FIGS. 2 and 4). The fixation block 15 is arranged with the comb port holes. In the insert-molding process, when the insulated housing 1 is combined with each of the receptacle terminals 200 and the fixation block 15, the plastic material is overflowed through each of the comb port holes, so that the plastic material may be distributed over the mold quickly, and the plastic material can form the shape of the insulated housing 1, thereby shortening the time of molding process. In the injection molding process, the coverage region 13 is devoid of the comb port holes to avoid the comb port holes from blocking the flow of the plastic material. Accordingly, it is effectively to improve the phenomenon of insufficient molding during the molding process, and to increase the strength of the electrical receptacle connector 100 products.

In this embodiment, each of the receptacle terminals 200 is placed on the fixation block 15 and combined with the insulated housing 1. In this embodiment, each of the grounding plates 7 is fixed on the fixation block 15, and each of the receptacle terminals 200 is placed on the fixation block 15 in a first molding processing procedure. The insulated housing 1 is molding out of each of the receptacle terminals 200 and the fixation block 15 in a second molding processing procedure.

In other words, after the type-c electrical receptacle connector 100 is inserted into and detached from a mating connector for a period of time, the debris 99 is easily piled up at the inner surface area of the tongue portion 12 of the insulated housing 1 due to the friction between the receptacle terminals 200 and the plug terminals 92. When the debris 99 is accumulated to a certain extent, the debris 99 may further occupy the space between the adjacent receptacle terminals 200, resulting in the contact of the adjacent receptacle terminals 200 to cause poor voltage-withstand performance or even cause the short circuit condition.

In this embodiment, the electrical plug connector 9 is inserted into the electrical receptacle connector 100 and held in a defined position. The contact ends 923 of the plug terminals 92 are adjacent to the coverage region 13 and keep a predetermined distance from the coverage region 13. After the electrical receptacle connector 100 is inserted into or detached from the electrical plug connector 9 for a period of time, the debris 99 is pushed to the coverage region 13 by the contact ends 923.

Figure 13:
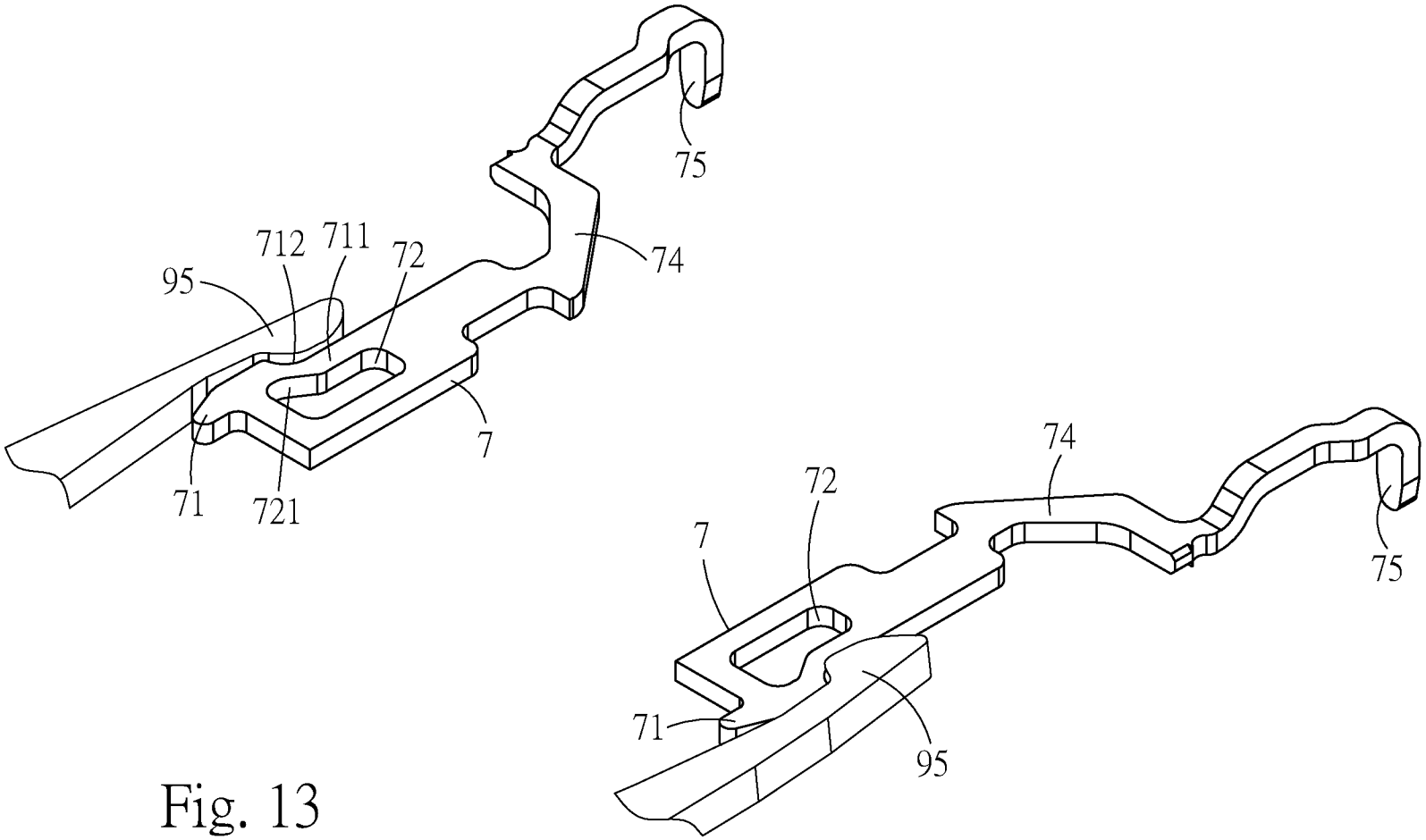
FIG. 13 illustrates a perspective view showing that each of the grounding plates is buckling with a hook, according to the electrical receptacle connector of the exemplary embodiment.

Please refer to FIGS. 1, 2, 4, 5, 12, and 13. FIG. 13 illustrates a perspective view showing that each of the grounding plates 7 is buckling with a hook 95. In this embodiment, the electrical receptacle connector 100 comprises a plurality of grounding plates 7. In the case that a plurality of grounding plates 7 is provided, each of the grounding plates 7 is held in the insulated housing 1. Each of the grounding plates 7 respectively comprises a hook structure 71 protruding out of the two ends of the tongue portion 12 and a plurality of through holes 72 adjacent to each of the hook structures 71.

Figure 14:
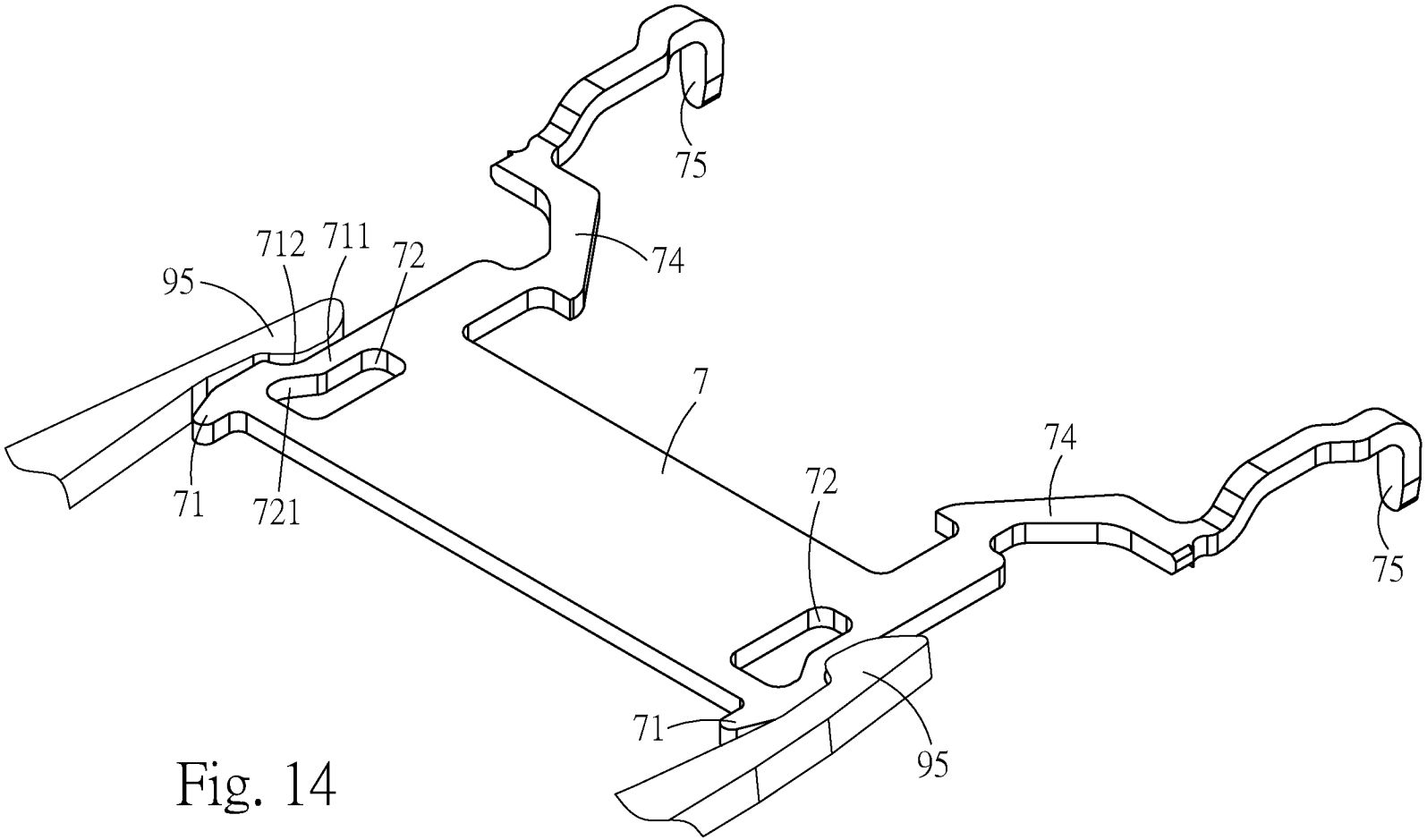
FIG. 14 illustrates a perspective view of another embodiment of a grounding plate of the electrical receptacle connector of the exemplary embodiment.

The number of the grounding plates 7 is not limited to embodiments of the instant disclosure. In some embodiments, the grounding plates 7 may be a one-piece structure, as a single grounding plate 7 (as shown in FIG. 14). In the case that a single grounding plate 7 is provided, the grounding plate 7 is held in the insulated housing 1. The two ends of the grounding plate 7 comprise a hook structure 71 protruding out of the two ends of the tongue portion 12 and a plurality of through holes 72 adjacent to each of the hook structures 71.

In the case that a single grounding plate 7 is provided, the grounding plate 7 is between the first terminals 2 and the second terminals 3. The grounding plate 7 is formed on the insulated housing 1 and is between the first contact portions 24 and the second contact portions 34. Specifically, the grounding plate 7 may be lengthened and widened, so that the front of the grounding plate 7 is near a front lateral surface of the tongue portion 12, two sides of the grounding plate 7 are near two sides of the tongue portion 12 for contacting the electrical plug connector 9, and the rear of the grounding plate 7 is near the rear of the tongue portion 12. Accordingly, the grounding plate 7 can be disposed on the tongue portion 12 and the base portion 11, and the structural strength of the tongue portion 12 and the shielding performance of the tongue portion 12 can be improved. That is, in this embodiment, the crosstalk interference can be reduced by the shielding of the grounding plate 7 when the first and second contact portions 24, 34 transmit signals. Furthermore, the structural strength of the tongue portion 12 can be improved by the assembly of the grounding plate 7.

In this embodiment, the hook structures 71 are respectively formed on the outside of each of the grounding plates 7. Each of the hook structures 71 is protruding out of the both sides of the front end of the tongue portion 12. When the electrical plug connector 9 is inserted in the electrical receptacle connector 100, the hooks 95 at both sides of the electrical plug connector 9 respectively buckle with each of the hook structures 71, and the hooks 95 at two sides of the electrical plug connector 9 would not wear against the tongue portion 12 of the electrical receptacle connector 100.

In this embodiment, a plurality of blocks 151 is outwardly protruding out of the fixation block 15 and is held with two sides of each of the receptacle terminals 200, respectively, and positioning slots are formed between each of the blocks 151 for positioning the receptacle terminals 200. Furthermore, part of the blocks 151 may be held in each of the through holes 72.

In this embodiment, an expansion portion 721 is formed in each of the through holes 72 and the expansion portion 721 is extending toward the hook structure 71, thereby increasing the space of each of the through holes 72 and increasing the area for plastic molding in the expanding portion 721. Furthermore, the blocks 151 are respectively in the position of the through holes 72 and the expanding portions 721 (as shown in FIG. 5). The blocks 151 are held between the both sides of the front end of the receptacle terminals 200.

In this embodiment, the two sides of the grounding plate 7 extend outwards with an extending portion 74 and legs 75. The blocks 151 are outwardly protruding out of the fixation block 15 and are held with two sides of each of the receptacle terminals 200, respectively, thereby improving the limiting of the receptacle terminals 200 in different parts, and improving the fixation of the receptacle terminals 200 on the fixation block 15. In addition, the legs 75 are protruding out of the back of the base portion 10 and soldered with the circuit board, so that the grounding plate 7 is provided for grounding and conduction.

In this embodiment, each of the grounding plates 7 comprises a contact arm 711 formed at the outside of each of the through holes 72. Furthermore, a buckle recess 712 is formed at the outer surface of each of the contact arms 711. When the electrical plug connector 9 is inserted in the electrical receptacle connector 100, the hooks 95 on both sides of the electrical plug connector 9 are buckling with the buckle recesses 712. While the electrical plug connector 9 is inserted into or detached from the electrical receptacle connector 100, the hooks 95 are in contact with the contact arms 711. The contact arms 711 move into the through holes 72, and the contact arms 711 swing elastically.

In other words, after the grounding plates 7 are provided with the through holes 72, the hook structure 71 forms a hollow elastic structure. Therefore, when the electrical plug connector 9 is mated with the electrical receptacle connector 100, the hooks 95 on both sides of the electrical plug connector 9 are in contact with the hook structures 71, and the contact arms 711 of the hook structures 71 swing inwardly to the through holes 72 in an elastic manner. Hence, it is to avoid that when the electrical plug connector 9 is mated with the electrical receptacle connector 100, the hooks 95 on both sides of the electrical plug connector 9 are in contact with the hook structures 71 in a poor interference manner, resulting in the abrasion of the hooks 95 on both sides of the electrical plug connector 9, thereby introducing problems of structural damage of the connector and poor contact between the terminals.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

an insulated housing comprising a base portion and a tongue portion, wherein the tongue portion is outwardly extending from one end of the base portion, and a coverage region adjacent to the base portion is held on a surface of the tongue portion;

a plurality of receptacle terminals, wherein the receptacle terminals are held in the base portion and disposed at an upper surface of the tongue portion or a lower surface of the tongue portion, each of the receptacle terminals comprises a body portion and a contact portion, the body portion is held in the base portion and the tongue portion, and the contact portion is outwardly extending from one end of the body portion and disposed at the upper surface of the tongue portion or the lower surface of the tongue portion, each of the receptacle terminals comprises an avoidance portion between the contact portion and the body portion, and the avoidance portion of each of the receptacle terminals is covered by the coverage region of the tongue portion, wherein a thickness of the avoidance portion of each of the receptacle terminals is less than a thickness of the contact portion of each of the receptacle terminals; and a metallic shell comprising a receptacle cavity, wherein the insulated housing is received in the receptacle cavity.

2. The electrical receptacle connector according to claim 1, wherein when a plurality of plug terminals of an electrical plug connector is in contact with the receptacle terminals of the electrical receptacle connector respectively, a plurality of debris is generated on the coverage region of the surface of the tongue portion on the avoidance portions.

3. The electrical receptacle connector according to claim 2, wherein the electrical plug connector is inserted into and positioned in the electrical receptacle connector, a plurality of contact ends of the plug terminals is adjacent to the coverage region.

4. The electrical receptacle connector according to claim 1, wherein an end of the avoidance portion of each of the receptacle terminals is in the base portion.

5. The electrical receptacle connector according to claim 4, wherein the coverage region covers from an end portion of the contact portion to an end portion of the base portion.

6. The electrical receptacle connector according to claim 1, wherein a thickness of the base portion is greater than a thickness of the tongue portion.

7. The electrical receptacle connector according to claim 1, wherein a covering range of the coverage region is from one of two sides of the tongue portion to the other side of the tongue portion.

8. The electrical receptacle connector according to claim 1, wherein the surface of the tongue portion at the coverage region and a surface of each of the contact portions are substantially aligned in a same horizontal plane.

9. The electrical receptacle connector according to claim 1, wherein the insulated housing further comprises two metal sheets arranged at two sides of the tongue portion, each of the metal sheets comprises a hook structure protruding from a side of the tongue portion and a through hole adjacent to the hook structure.

10. The electrical receptacle connector according to claim 9, further comprising a fixation block, each of the receptacle terminals is at a position one the fixation block and combined with the insulated housing.

11. The electrical receptacle connector according to claim 10, wherein a plurality of blocks is outwardly protruding from the fixation block and held with two sides of each of the receptacle terminals; the blocks are received in the through holes, respectively.

12. The electrical receptacle connector according to claim 10, wherein each of the through holes has an expanded portion extending to the corresponding hook structure.

13. The electrical receptacle connector according to claim 10, wherein an extension portion and a soldering leg are outwardly extending from two sides of each of the metal sheets, a plurality of blocks are outwardly protruding from the fixation block and are held with two sides of each of the extension portions.

14. The electrical receptacle connector according to claim 1, wherein the insulated housing further comprises a metal sheet arranged at two sides of the tongue portion, the metal sheet comprises a plurality of hook structures protruding from a side of the tongue portion and a plurality of through holes respectively adjacent to the hook structures.

15. The electrical receptacle connector according to claim 14, further comprising a fixation block, each of the receptacle terminals is at a position on the fixation block and combined with the insulated housing.

16. The electrical receptacle connector according to claim 15, wherein a plurality of blocks is outwardly protruding from the fixation block and held with two sides of each of the receptacle terminals; the blocks are received in the through holes, respectively.

17. The electrical receptacle connector according to claim 15, wherein each of the through holes has an expanded portion extending to the corresponding hook structure.

18. The electrical receptacle connector according to claim 15, wherein a plurality of extension portions and a plurality of soldering legs are outwardly extending from two sides of the metal sheet, a plurality of blocks are outwardly protruding from the fixation block and are held with two sides of each of the extension portions.

* * * * *